US005639202A

United States Patent [19]

Roycraft

[11] Patent Number: 5,639,202

[45] Date of Patent: Jun. 17, 1997

[54] REFUSE BAG OPENER

[75] Inventor: Frank Roycraft, Mansfield, Ohio

[73] Assignee: Magnificent Machinery, Inc., Lorain, Ohio

[21] Appl. No.: 300,975

[22] Filed: Sep. 6, 1994

Related U.S. Application Data

[63] Continuation-in-part of Ser. No. 6,818, Jan. 21, 1993, abandoned.

[51] Int. Cl.[6] ..... B02C 19/22

[52] U.S. Cl. ..... 414/412; 198/671; 198/550.1; 241/186.5; 241/DIG. 38; 414/326

[58] Field of Search ..... 414/297, 412, 414/310–312, 315, 319, 321, 323, 326; 241/182, 186.5, DIG. 38; 239/660, 676; 198/524, 531, 550.1, 670, 671; 222/412, 413, 63

[56] References Cited

U.S. PATENT DOCUMENTS

| | | | |
|---|---|---|---|
| 1,880,155 | 9/1932 | Ruth | 239/660 |
| 2,256,655 | 9/1941 | Stewart | 239/660 |
| 2,717,742 | 9/1955 | Neigham et al. . | |
| 2,940,639 | 6/1960 | Winter | 222/412 X |
| 3,254,798 | 6/1966 | Buschbom | 222/63 X |
| 3,258,165 | 6/1966 | Guyer | 222/63 |
| 3,300,032 | 1/1967 | Dion | 198/550.1 |
| 3,393,875 | 7/1968 | Bryant, Jr. | 239/660 |
| 3,447,669 | 6/1969 | Mayrath | 198/670 X |
| 3,807,470 | 4/1974 | Young . | |
| 3,860,182 | 1/1975 | Peterson . | |
| 4,043,514 | 8/1977 | Peterson . | |
| 4,077,575 | 3/1978 | Tillmanns | 241/182 X |
| 4,181,461 | 1/1980 | Bernicot | 414/412 |
| 4,182,592 | 1/1980 | Henryson . | |

(List continued on next page.)

FOREIGN PATENT DOCUMENTS

| | | | |
|---|---|---|---|
| 0571050 | 2/1959 | Canada . | |
| 3332703 | 3/1985 | Germany | 414/310 |
| 0028026 | 3/1981 | Japan | 239/660 |
| 0047218 | 2/1988 | Japan | 198/524 |
| 0271305 | 10/1989 | Japan | 414/326 |
| 4057728 | 2/1992 | Japan . | |
| 0621615 | 8/1978 | U.S.S.R. . | |
| 1150167 | 4/1985 | U.S.S.R. . | |
| 1330021 | 8/1987 | U.S.S.R. . | |
| 1335507 | 9/1987 | U.S.S.R. . | |

*Primary Examiner*—James W. Keenan
*Attorney, Agent, or Firm*—Renner, Otto, Boisselle & Sklar, P.L.L.

[57] ABSTRACT

A bag opening machine includes a trough and a feed screw that is rotatably mounted in the trough to advance bags that at least partially fit between the flight of the feed screw along the length of the trough. There are a pair of restrictions that the bags encounter that cause the bags to be ripped open as the part of a bag caught between the flight continues to advance while the part that is not within the flight is blocked from further advancement. The machine has a shear plate running the length of the trough which not only enhances longevity, but also provides a surface against which bags between the flight rub to be opened. Each of the restrictions is lined with another shear plate, and the leading faces of the restrictions are also reinforced against wear. An expansion chamber is located between the two restrictions. The restrictions completely surround the feed screw, which is mounted eccentrically in the opening defined by the feed screw. The clearance between the feed screw and the opening is selected to maximize through-put of bags while minimizing breakage of materials in the bags, especially glass. An alternative embodiment includes a feed-back controlled gate which enlarges one or both of the restrictions when the load on the motor is such as to indicate that the motor is about to stall. The gate stays in the open position until the feed screw had completed a full revolution and then it is returned to its initial position. A hinged lid over the expansion chamber helps prevent the build-up of excess material. At the outlet end, the feed screw has a conical anti-clogging device that directs materials out of the feed screw, especially long strips that might have gotten wrapped around the feed screw.

6 Claims, 3 Drawing Sheets

U.S. PATENT DOCUMENTS

| | | | |
|---|---|---|---|
| 4,265,584 | 5/1981 | Duwell et al. | 414/412 |
| 4,274,787 | 6/1981 | Mueller et al. . | |
| 4,278,384 | 7/1981 | Marchesini . | |
| 4,310,089 | 1/1982 | Bondeson et al. | 198/671 X |
| 4,373,668 | 2/1983 | Forbes et al. | 239/670 X |
| 4,555,212 | 11/1985 | Jones | 414/412 |
| 4,852,817 | 8/1989 | Tipton . | |
| 4,930,968 | 6/1990 | Borglund . | |
| 4,995,770 | 2/1991 | Crane . | |
| 5,002,451 | 3/1991 | Hale et al. . | |
| 5,232,168 | 8/1993 | Lybecker et al. . | |
| 5,368,432 | 11/1994 | Schoenhard | 414/412 |
| 5,433,577 | 7/1995 | Roycraft | 414/412 |

REFUSE BAG OPENER

RELATED APPLICATION

This application is a continuation in part of U.S. patent application Ser. No. 08/006,818, filed Jan. 21, 1993, now abandoned.

FIELD OF THE INVENTION

The present invention relates to automated openers for bags containing refuse, especially recyclable refuse, and to such a bag opener with improved efficiency, wear, and safety characteristics.

BACKGROUND OF THE INVENTION

In the recycling industry, one substantial problem is to open bags containing recyclable materials. This problem arises because many communities require residents to place all their recyclables in a single plastic or heavy duty paper bag. These bags are then collected and delivered to a recycling center where the bags are opened, and the various recyclable materials are sorted.

Reliably and safely opening the bags is a difficult task, and many recycling centers have been able to accomplish this task only with excessive manual labor. The difficulty arises in part because the bags must be made strong enough to withstand the rough handling they are likely to encounter between the time residents fill the bags and the time they arrive at the recycling center. The toughness which allows the bags to arrive intact also makes them hard to open.

A second problem any bag opener must address is worker safety. The bags of recyclables may not only contain relatively benign items such as empty plastic beverage containers, but they may also contain more dangerous items such as propane tanks and aerosol cans of various types. These containers and their contents may pose significant hazards to those who must work sorting the contents of bags containing recyclable materials. An automated bag opener should be able to open bags while breaking as few of the contents as possible, and do this at a speed that makes the financial investment in bag opening machinery economical compared to the manual alternative.

Further the bags may contain materials that could easily damage any equipment used to open the bags. Such materials include large pieces of lumber, e.g., odd bits of 4"×4", as well as glass. Glass poses a special problem since when it is broken, it is difficult or impossible to sort into the appropriate recycling category, and broken glass is exceedingly abrasive and therefore causes excessive wear on any machinery it contacts. Moreover, some items such as bundles of newspapers found in bags of refuse may tend to jam a bag opening machine. A machine that is used to open bags must be able to handle safely all of these materials with a minimum of down time for repairs or unjamming of the machine.

Equipment available before now has addressed some of these problems but has not been entirely successful in addressing the wear problem caused by abrasive materials, and worker safety and efficiency can always be improved. One prior art device for opening bags is that illustrated in U.S. Pat. No. 4,555,212. It includes a feed screw positioned in a tube. The tube has been partially cut away to form an inlet area at one end of the screw and a discharge area at the opposite end of the screw. The inlet area has wings that form a trough to direct bags toward the feed screw. Two portions of the tube between the inlet and discharge areas remain intact. In these two portions the tube completely surrounds the feed screw to form restrictions where the bags are severed. An expansion chamber is located between the two restrictions. In the expansion chamber the recyclables and any unopened bags are tumbled before going through the second, bag-rupturing restriction. After the feed screw advances the bags and their contents through the second restriction, they move to the discharge area where they spill onto a conveyor belt for further sorting.

The device described has proven effective, but it is also subject to premature wear, and it may have difficulty dealing with materials that are not easy to shear. The expansion chamber is open and might present a hazard. Moreover the feed rate of the screw must sometimes be slowed down because material accumulates in the expansion chamber.

SUMMARY OF THE PRESENT INVENTION

The present invention provides a number of significant advantages over prior art machines like that shown in U.S. Pat. No. 4,555,212, the entire disclosure of which is incorporated herein by reference. Specifically, the trough of the present invention includes a shear plate running the length of the trough under the feed screw to provide added durability and an edge against which bags containing recyclables, especially small bags, may be sheared open. Additionally, shear plates line the top part of each restriction. These shear plates each have a serrated leading edge which engages the bags and friable contents of the bags to help shear them. Each restriction has a face perpendicular to the axis of the feed screw which is protected by a replaceable wear plate.

The shape of the restrictions has also been selected to increase effectiveness. To this end the restriction and the trough together make an eccentric opening through which the feed screw passes. The clearance between the feed screw and the restriction is smallest at the bottom of the trough and largest at the top, with the clearance being selected to allow ample through-put speeds while keeping breakage of glass to a minimum.

Between the two restrictions is an expansion chamber covered with a movable lid which tends to force excess material in the expansion chamber back into the feed screw. In the event that recyclable materials build up in the expansion chamber, the pressure will cause the lid to lift, thereby alerting the machine operators. The lid is arranged so that as it opens, materials within are exposed only to one direction. Should the materials overflow the expansion chamber, the detritus will be directed back into the trough upstream of the first restriction. In the unlikely event of an explosion, the explosive force will be directed in a single direction, away from the workers.

The present invention also provides an anti-jamming disc at its discharge end. This disc deflects into the discharge opening materials which might get stuck on or wrapped around the feed screw, such as long pieces of wire or plastic.

Additionally, the restriction may include a gate which moves up to enlarge the restriction through which the items must pass if the machine begins to stall. A controller keeps the gate up until the material causing the jam have passed.

DESCRIPTION OF PREFERRED EMBODIMENTS

Figure 1:
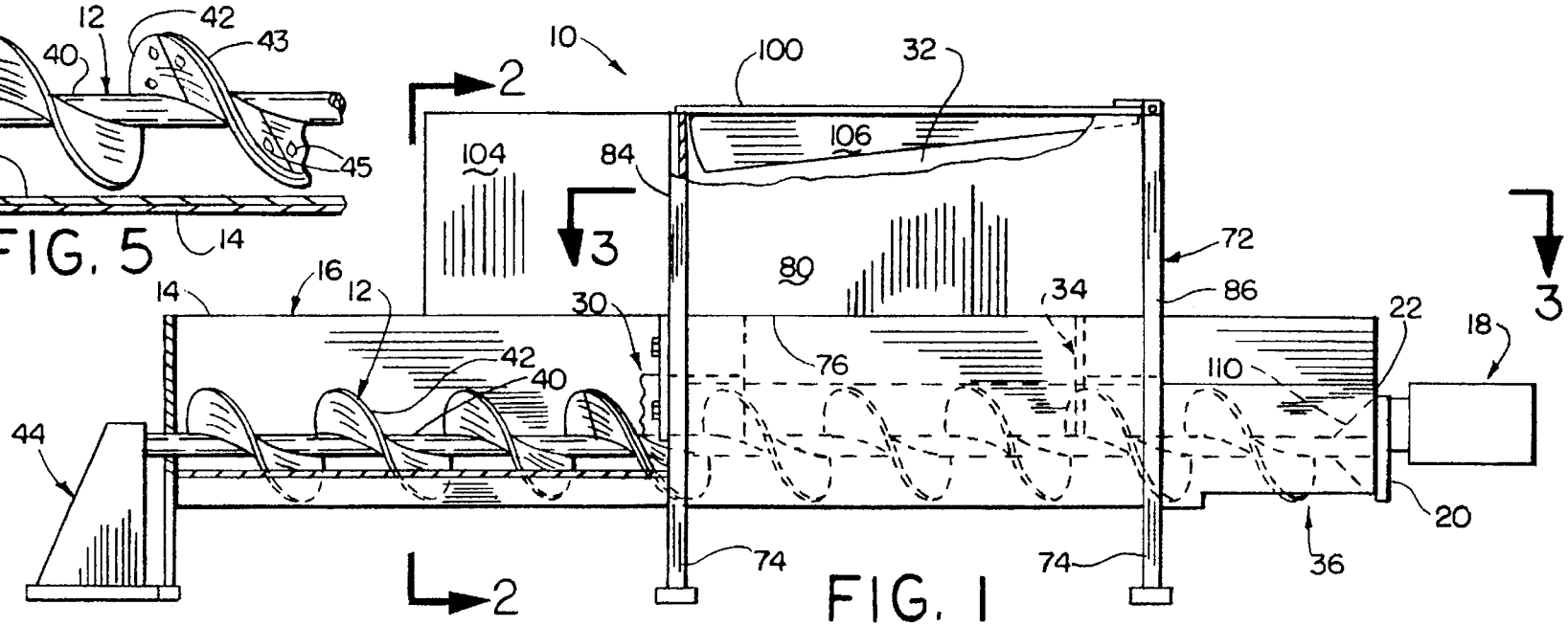
FIG. 1 is a side elevation view of an improved refuse bag opener constructed in accordance with the present invention, with the trough thereof partly in section to reveal the feed screw.

FIG. 1 illustrates an improved apparatus 10 for rupturing bags constructed according to the precepts of the present invention. The apparatus 10 includes a feed screw 12 supported in a transport trough 14 which surrounds a portion of the bottom of the feed screw, leaving the top exposed. The trough 14 forms an inlet end 16 where bags containing recyclables may be dumped. The feed screw 12 is driven by a suitable motor such as the electric motor 18 and reduction gearing 20 mounted on end wall 22 which closes the end of the trough 14.

The feed screw 12 carries bags containing recyclables through a two stage rupturing process. The bags encounter a first restriction 30 which opens most of the bags. The contents and the ruptured bags move through the first restriction 30 into an expansion chamber 32 where they are agitated, and then they pass through a second restriction 34 where the majority of any unopened bags are ruptured. Ultimately the bags and their contents are discharged from a discharge opening 36 onto a conveyor (not shown) for further sorting and processing.

Figure 5:
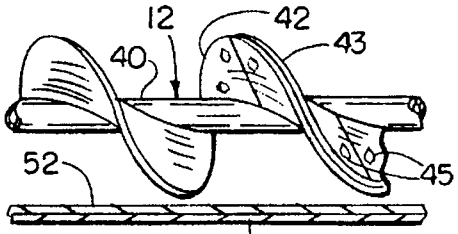
FIG. 5 is an enlarged view of a portion of the feed screw of FIG. 1 showing reinforcement of the feed screw in the region of the first restriction.
Figure 2:
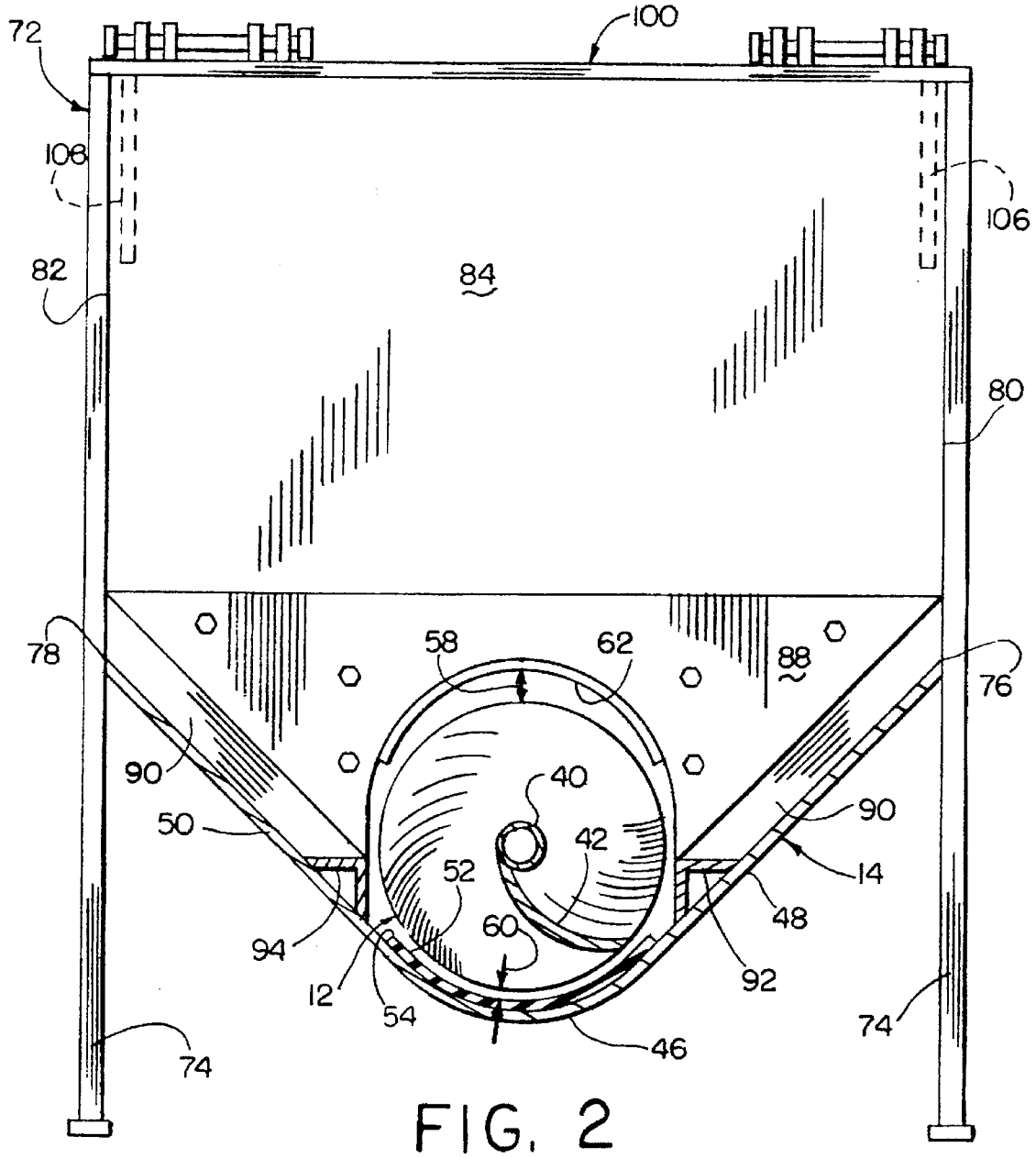
FIG. 2 is sectional view looking in the direction of arrows 2—2 of FIG. 1 showing a shear plate lining the bottom of the trough, the first restriction, and the shear and wear plates on the first restriction.

The feed screw 12 is formed of a 5 inch diameter steel tube 40 (FIGS. 1 and 2), and a helical flight 42 which has a 24 inch diameter. The flight 42 makes a complete revolution each 24 inches of the tube 40. The feed screw 12 is supported by a mounting assembly 44 at its inlet end. The mounting assembly 44 includes a conventional thrust beating (not shown). The opposite end of the feed screw is also mounted with a conventional thrust bearing (not shown). The thrust bearings hold the feed screw 12 above the bottom of the trough 14, as shown in FIG. 2. In a preferred embodiment the tube 40 is a Schedule 80 pipe and the flight is one-half inch mild steel. Further in this preferred embodiment the feed screw 12 may be reinforced from the convolution of the flight 42 that immediately precedes the first restriction 30 and continues through that restriction as shown in FIG. 5. As shown in FIG. 5, the reinforcing may take the form of a relaceable wear plate 43 which is removably held in place by means of nuts and bolts 45 or other suitable fasteners.

In cross-section the trough 14 (FIG. 2) has the shape of a rounded V. The rounded, bottom portion 46 of the trough 14 surrounds about one quarter of the flight 42 of the feed screw 12. From opposite sides of the rounded portion 46, straight walls 48 and 50 extend upward at about 90 degrees to each other. The trough 14 extends the entire length of the feed screw 12 as shown in FIG. 1. At the inlet end 16 the trough 14 is open upward, and so forms a place where bags containing recyclable refuse can be placed in the machine 10.

The trough 14 is partially lined with a shear plate 52 (FIG. 2) that extends the entire length of the trough from the inlet end to the upstream end of the discharge opening 38. This shear plate 52 performs two functions. First, it provides a replaceable element which extends the life of the trough 14. Also it presents a lengthwise edge 54 in the trough 14. Bags that are smaller than standard might fit completely between the flight 42 of the feed screw 12 and pass through the restrictions 30 and 34 unopened. These bags tend to be sheared open by the edge 54 of the reinforcing plate 52.

When a bag containing recyclable materials is placed in the trough 14, part of the bag fits between the flight 42 of the feed screw 12. As the feed screw 12 turns, the bag advances along the conveyor until it hits the first restriction 30. When the bag arrives at the restriction 30, it is effectively sheared open because a portion of the bag and its contents fits between the flight 42 of the feed screw 12 and is pulled downstream while the remaining portion is blocked from further advancement by the restriction 30. As the bag is sheared open, the items within it fall down into the spaces between the feed screw flight 42 and advance downstream in the trough 14.

The restrictions 30 and 34 are substantially identical, and only the restriction 30 is shown or described in detail. However, it will be understood that this description applies equally to the restriction 34. The restriction 30 is shaped for maximum wear and for efficiency. The restriction 30 is shaped so that the feed screw 12 is eccentric, with a larger clearance 58 (FIG. 2) between the feed screw 12 and the restrictions at the top than at the bottom 60. It has been found that a uniform clearance of, for example, one half inch, as used in the prior art device described above, does not operate efficiently. While such a clearance results in little unnecessary glass breakage, it also results in a machine that tends to bog down. By increasing the clearance 58 at the top of the feed screw to between 2.5 and 3.5 inches, the feed screw speed can be increased. However, if the clearance is larger than that specified, then glass breakage increases, and this in turn results in rapid abrasion of the machinery and unnecessary loss of recyclable materials.

Figure 3:
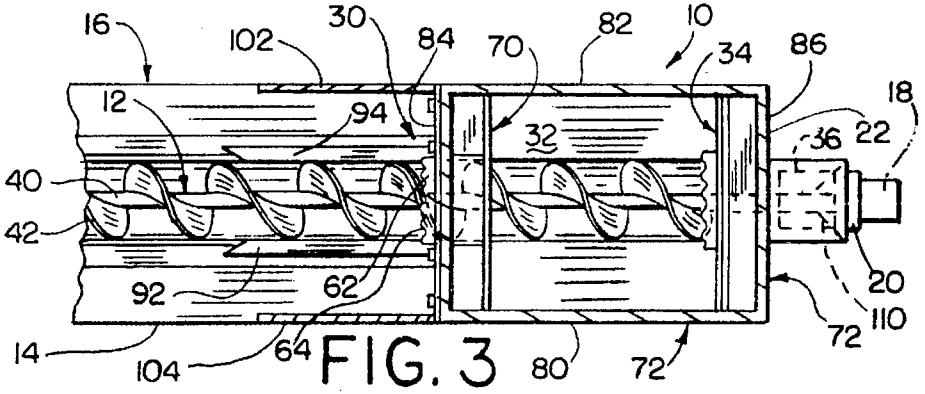
FIG. 3 is a view looking in the direction of arrows 3—3 in FIG. 1.

The restriction 30 is faced with a shear plate 62 (FIGS. 2 and 3) that extends along the length of the feed screw 12. The shear plate 62 is semi-circular with a 12.5 inch radius. The leading edge 64 of the shear plate 62 is serrated with a wavy edge. This leading edge 64 helps to grab the bag material as it is being forced through the restriction 30 and to shear some oversized recyclables.

Figure 4:
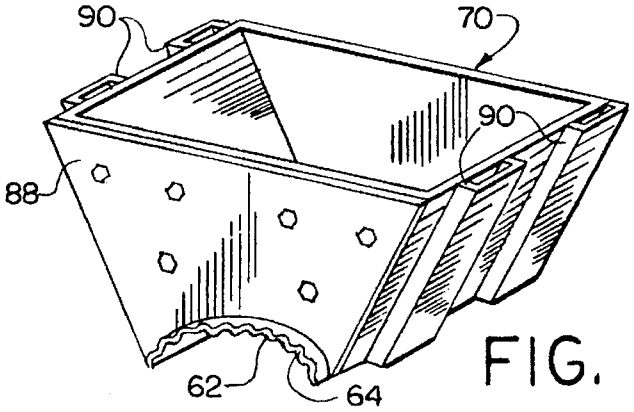
FIG. 4 is a perspective view of an element forming a part of the restriction of FIG. 1.

The restriction 30 is formed by inserting a shroud 70 (FIG. 4) into the expansion chamber 32. The expansion chamber 32 is formed by a rectangular box 72 open on its bottom and mounted on legs 74 which straddle a part on the trough 14 and feed screw 12. The bottom edges 76 and 78 of the side walls 80 and 82, respectively, of the box 72 are connected to the upper edges of the walls 48 and 50, respectively, of the trough 14. The upstream wall of shroud 70 is mounted in vertical alignment with the upstream or front wall 84 of the expansion chamber 32 to form the restriction 30, while an identical shroud is mounted with its downstream face in vertical alignment with the opposite down stream or rear wall 86 of the expansion chamber to form the second restriction 34.

The shroud 70 (FIG. 4) is roughly trapezoidal, like a wedge-shaped piece of cheese, to fit the trough 14 and is cut away in a semi-circle to clear the feed screw 12. The shroud 70 mounts the shear plate 62 so that its axis of curvature is parallel to the axis of the feed screw 12. The shroud 70 also supports a wear plate 88 on the upstream face of the shroud. This replaceable wear plate 88 serves to stiffen the front of the shroud 70 and prolong its life.

Spacers 90 (FIGS. 2 and 4) fit between the shroud 70 and the walls 48 and 50 of the trough 14. Four such spacers are shown. By varying the thickness of the spacers 90 the size of the clearance 58 (FIG. 2) can be varied according to particular needs. It has been discovered that having the clearance 58 at about 2.5 inches, while the clearance 60 below is one-half inch, results in a significant increase in through-put of bags and recyclables and that an increase in the upper clearance above 3.5 inches causes an increase in glass breakage.

In the event that some article in a bag gets caught between the wear plate 62 and the flight 42 of the feed screw 12, the motor 18 will continue turning the feed screw 12 until either the article gets drawn through the restriction, the article gets sheared, or the bag opener 10 stalls. During this time the torque on the feed screw 12 tends to deflect the feed screw upward from its position in the trough 14. The trough 14 includes a pair of angles 92 and 94 that are welded to the side walls 48 and 50, respectively, of the trough 14 to stabilize the feed screw 12 when it is under such heavy loads. The angles extend in an upstream direction from the first restriction 30 about one-half the length of the inlet end 16.

The shroud 70, spacers 90, and trough 14 cooperate to form an obround opening, i.e., an opening with semicircular ends connected by parallel, straight sections. This shape contributes to keeping the feed screw 12 in its desired location. The opening is shaped so that the maximum deflecting forces acting on the feed screw 12 tend to be downward directed. This occurs because bags and their contents are drawn into the opening most easily as they turn past the increasingly large clearance 58 at the top of the opening. When the bags and contents reach the apex of the clearance 58, they tend to be squeezed against the shear plate 62, with the resulting force tending the deflect the feed screw 12 in a direction that is below the horizontal midline of the feed screw. The angles 92 and 94 provide additional restraint to keep the feed screw 12 in its desired position by providing a reaction surface for any deflecting forces that are not directed toward the curved bottom portion 46 of the trough 14.

The expansion chamber 32 has a hinged lid 100 which closes the top of the expansion chamber. The lid 100 is hinged along the top of the downstream wall 86 of the box 72. When the bags and their contents reach the expansion chamber 32, most of the bags have been ruptured. Some few bags may have gotten through the first restriction 30 without breaking open. These are agitated by contact with the other recyclable materials in the expansion chamber 32, and desirably reorient themselves so that when they are carried through the second restriction 34, they will be ruptured.

The expansion chamber 32 occasionally fills completely with material when material is passing through the first restriction 30 faster than the second restriction 34. When the expansion chamber 32 fills, the weight of the lid 100 tends to force the accumulated material down into the space between the flight 42 of the feed screw 12. This in turn increases the flow rate through the second restriction 34 and re-establishes equilibrium between the flow rates in and out of the expansion chamber 34. In the event that the flow rates do not equalize, the lid 100, being hinged, lifts, and excess debris spills over the upstream wall 84 of the expansion chamber 32. When this occurs, the excess debris is directed back toward the feed screw 12 by guide walls 102 and 104 (FIGS. 1 and 3) which extend vertically upwardly from the top edges of the trough 14 over a portion of the inlet end 16 of the trough.

The lid 100 has two downward depending wings 106 and 108 (FIGS. 1 and 2) which are mounted just inside the edges of the lid adjacent to the front and rear walls 80 and 82, respectively, of the box 70. When the lid 100 is partially open as during an overflow, the wings 106 and 108 prevent the egress of material from the expansion chamber 32 over the side walls 84 and 86, respectively, of the box 70, to the right and left as viewed in FIG. 2. Thus in the event of an overflow or explosion, debris will fall principally over the upstream wall 84 of the expansion chamber 32.

When the recyclable material has passed through the second restriction 34 (Figure 1), the feed screw 12 pushes it toward the discharge opening 36 which is formed in the bottom of the downstream end of the trough 14. The flight 42 ends short of the end of the tube 40, so that there is a short segment of tube that has no flight. After this short segment, there is a discharge disc 110. The discharge disc is a conical disc, tapering outward and away from the tube 40 toward the end wall 22 which closes the downstream end of the trough 14. The discharge disc 110 deflects materials, especially linear materials such as wire or long strips of plastic that might be wound around the feed screw 12, out toward the discharge opening 36.

Figure 6:
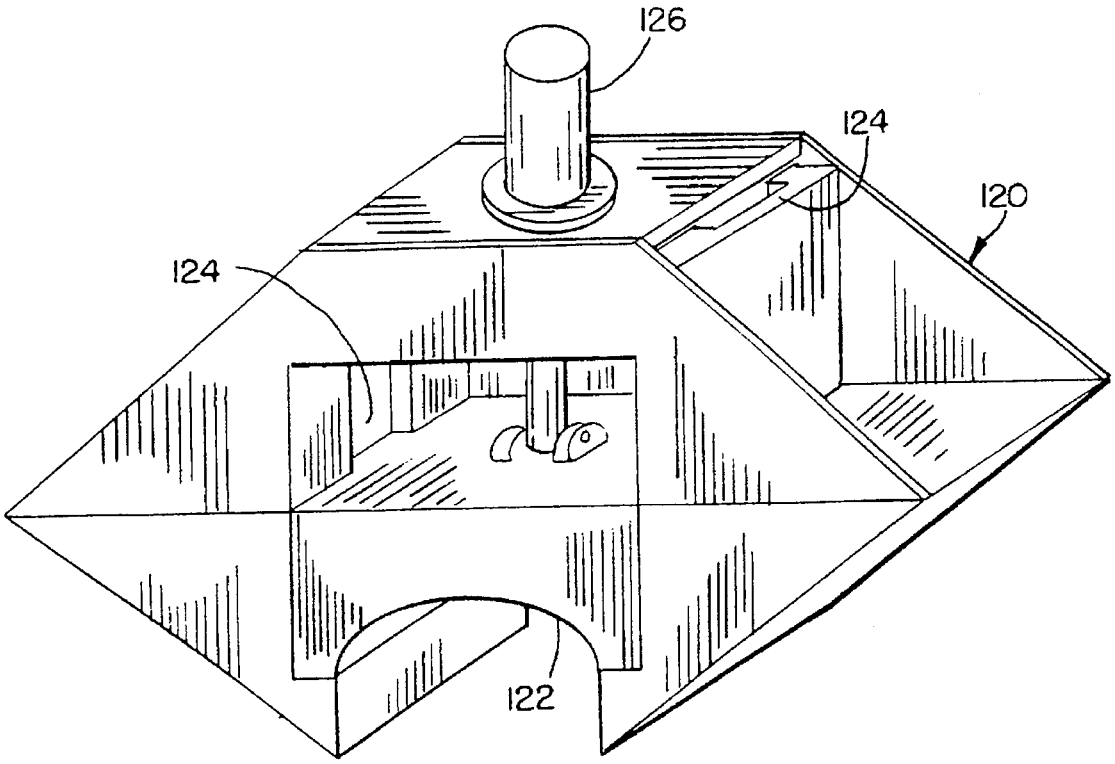
FIG. 6 is a perspective illustration of an alternative embodiment of the element forming a part of the restriction of FIG. 1 and which includes a moveable gate.

As an alternative to the shroud 70, the present invention also provides the shroud 120 (FIG. 6). The shroud 120 fits in the box 72 in the same way as the shroud 70 and serves generally the same purpose. However the shroud 120 includes a vertically moveable gate 122 which defines the top of the obround opening through which the bags must pass. The gate 122 is moveable upward to permit materials which might otherwise jam or stall the machine 10 to pass through as described below.

The gate 122 is vertically slidable in tracks 124; it is moved by a hydraulic cylinder 126 whose piston is attached to the top of the gate and whose cylinder is fixed to the shroud 120. The gate 122 is moveable by the cylinder 126 from a closed or lower position in which it forms an obround opening the same as the shroud 70 to an open or upper position in which the opening is enlarged. Of course, the stroke of the cylinder 126 determines how great the enlargement is, but four inches is believed to be sufficient for most municipal refuse.

The hydraulic cylinder 126 is not the only way to lift the gate 122, and any suitable mechanism, such as a scissors jack or mechanical linkage could be used. The significant criteria are the ability to move the gate 122 up and down on command and to apply a large amount of force to hold the gate in its closed position during normal operation.

Figure 7:
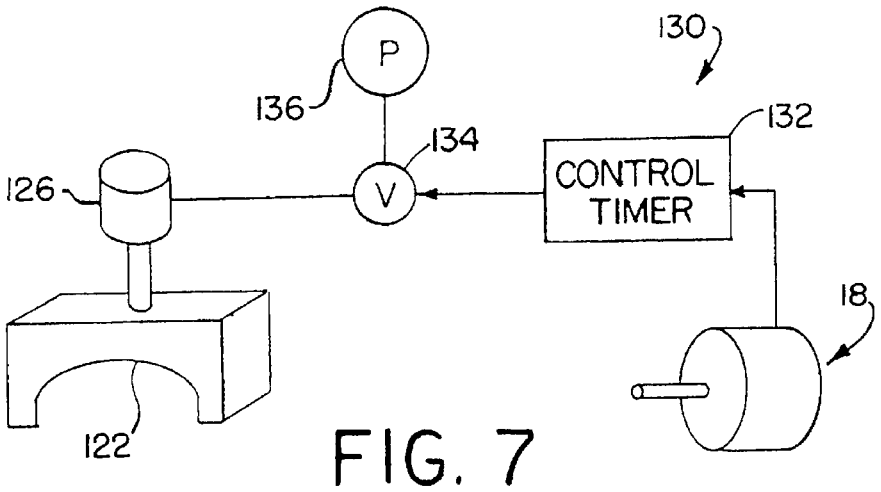
FIG. 7 is a schematic illustration of a control circuit used to operate the gate of FIG. 6.

A control circuit 130 (FIG. 7) is used to control the movement of the gate 122. The control circuit includes a control/timer unit 132 which receives as inputs signals representing the speed of rotation of the motor 18 and the amount of torque the motor is providing. Based on these inputs, the controller/timer 132 determines whether the motor 18 is about to stall. If the motor 18 is about to stall, the controller/timer 132 opens valve 134 which causes hydraulic fluid under pressure from pump 136 to actuate cylinder 126 to move the gate 122 from its closed position to its open position. This allows whatever material might have been causing the jam to pass through the restriction formed by the shroud 120. The controller also includes a timer circuit. This circuit governs when the gate is returned to its closed, lower position. The controller/timer 132 is arranged so that the gate 122 is moved down to its closed position after the feed screw 12 has completed one full revolution. The amount of time this takes is dependent on the speed and helix angle of the feed screw, and the controller uses the speed of the feed screw to determine how long the gate 122 should remain in the upper position. The helix angle of the feed screw for any given machine is a constant and can be programmed in advance into the controller.

Thus it is clear that the present invention provides a number of significant advantages over prior art machines like that shown in U.S. Pat. No. 4.555,212. For example, the trough 14 of the present invention includes a shear plate 52 running the length of the trough under the feed screw 12 to provide added durability and an edge against which bags containing recyclables, especially small bags, may be sheared open. Additionally, a shear plate 62 lines the top part of each restriction 30 and 34. The serrated leading edges 64 of the shear plates 62 engages the bags and friable contents of the bags to help shear them.

The shape of the restrictions 30 and 34 has also been selected to increase effectiveness. To this end each restriction 30, 34 and the trough 14 together make an eccentric opening through which the feed screw 12 passes. The clearance between the feed screw 12 and the restriction 30, 34 is smallest at the bottom of the trough (60) and largest at the top (58), with the clearance being selected to allow ample through-put speeds while keeping breakage of glass to a minimum.

Between the two restrictions 30 and 34 is an expansion chamber 32 covered with a movable lid 100. In the event that recyclable materials build up in the expansion chamber 32, the pressure will cause the lid 100 to lift, thereby alerting the machine operators. The lid 100 is arranged so that as it opens, materials within are exposed only to one direction, toward the inlet end of the trough. Therefore, should the materials overflow the expansion chamber 32, the detritus will flow in only one direction and generally into the inlet 16 for reprocessing.

Optionally, a moveable gate 122 (FIG. 6) may form part of one (or both) of the restrictions 32 and 34. The gate 122 may be lifted automatically to enlarge the restriction when the motor 18 is about to stall.

Additionally, the present invention provides an anti-jamming disc 110 at its discharge end. The disc 110 deflects into the discharge opening materials which might get stock on the feed screw, such as long pieces of wire or plastic.

What is claimed is:

1. An improved apparatus for rupturing bags comprising:

an axially extending transport trough for receiving bags of material, the trough having an inlet end and an outlet end, a feed screw rotatably mounted in said trough for conveying the bags of material along the trough, said trough surrounding a lower portion of the circumference of the feed screw, a first restriction cooperating with the trough surrounding the feed screw and defining an opening through which the feed screw carries the bags of materials, the feed screw including a helically wound flight proportioned to receive a portion of a bag containing material with the remainder of the bag being radially outward of the flight as it is carried from the inlet end of the trough by the feed screw toward the first restriction, the first restriction including an opening of decreasing cross section as viewed in the direction of rotation of the feed screw and having a surface disposed to engage the remainder of the bag so as to block further axial movement of that portion of the bag which is disposed radially outward of the surface of the opening, and an anti-clogging conical shield connected to the feed screw and rotatable therewith to force linear materials radially outward as the flight of the feed screw moves such materials axially.

2. An improved apparatus for rupturing bags comprising:

an axially extending transport trough for receiving bags of material, the trough having an inlet end and an outlet end, a feed screw rotatably mounted in said trough, the trough surrounding the lower portion of the circumference of the feed screw, a motor connected to the feed screw, the feed screw advancing the bags of material along the trough upon rotation of the motor, a restriction mounted on the trough and cooperating with the trough to completely surround the feed screw for a portion of its length and defining an opening larger than the diameter of the feed screw and with an upstream edge against which the bags of material are sheared as they are advanced by the feed screw, the restriction including a movable gate and a mechanism connected between the trough and the gate to move the gate to vary the size of the opening, and a controller which measures the load on the motor and moves the gate to increase the size of the opening when the load on the motor exceeds a predetermined limit.

3. The apparatus of claim 2 wherein the gate is movable between a closed position in which the size of the opening is at its minimum and an open position which the size of the opening is at its maximum, and the controller includes a timer to keep the gate at its open position for as long as it takes the feed screw to complete one revolution and thereafter the controller returns the gate to its closed position.

4. A bag rupturing machine including a trough, a feed screw rotatably mounted in the trough, a motor connected to the feed screw to advance bags of material along the length of the trough and through a restriction surrounding the feed screw as the motor rotates the feed screw, and an anti-stall device comprising, a movable gate which forms part of the restriction, powered means for moving the gate with respect to the feed screw, and a controller which measures the load on the motor and activates the powered means to move the gate when the load on the motor exceeds a predetermined limit, the gate being movable between a closed position in which the restriction around the feed screw is at its smallest and an open position in which the restriction is at its largest, and wherein the controller activates the powered means to move the gate from its closed position to its open position when the load on the motor exceeds the predetermined limit.

5. The bag rupturing machine of claim 4 wherein the controller further includes a timer which keeps the gate in its open position for a single complete revolution of the feed screw and thereafter activates the powered means to return the gate to its closed position.

6. An improved apparatus for rupturing bags comprising:

an axially extending transport trough for receiving bags of material, the trough having an inlet and an outlet end, a feed screw rotatably mounted in said trough for conveying the bags of material in the axial direction along the trough, said trough surrounding a lower portion of the circumference of the feed screw, a first restriction cooperating with the trough to surround the feed screw to define an opening transverse to the axis of the feed screw through which the feed screw carries the bags of materials, the feed screw including a helically wound flight proportioned to receive a first portion of a bag containing material with a second portion of the bag being radially outward of the flight as it is carried from the inlet end of the trough by the feed screw toward the restriction, the feed screw being mounted eccentrically of the opening defined by the trough and the first restriction to form a clearance between the opening and the flight of the feed screw that varies about the circumference of the feed screw, and said first restriction including a surface radially outward of the opening to engage that part of the second portion of the bag and the materials therein carried by the feed screw which extend radially outward beyond the opening so as to prevent the further axial movement of such materials at least until the bag ruptures, and wherein the first restriction includes a movable gate and a mechanism connected between the trough and the gate to move the gate to vary the size of the opening, and a controller which measures the load on the motor and moves the gate to increase the size of the opening when the load on the motor exceeds a predetermined limit.

* * * * *